United States Patent [19]

Bugg

[11] Patent Number: 4,682,161

[45] Date of Patent: Jul. 21, 1987

[54] VARIABLE SIZE CHARACTER DISPLAY WITHOUT LOSS OF OBSCURED CHARACTER POSITIONS

[75] Inventor: Richard E. F. Bugg, Coulsdon, England

[73] Assignee: U.S. Philips Corporation, New York, N.Y.

[21] Appl. No.: 643,338

[22] Filed: Aug. 22, 1984

[30] Foreign Application Priority Data

Sep. 1, 1983 [GB] United Kingdom ..... 8323401

[51] Int. Cl.[4] ..... G09G 1/06

[52] U.S. Cl. ..... 340/731; 340/735; 340/748; 340/790; 340/798

[58] Field of Search ..... 340/723, 729, 730, 731, 340/735, 748, 750, 790, 798, 799

[56] References Cited

U.S. PATENT DOCUMENTS

| | | | |
|---|---|---|---|
| 4,254,409 | 3/1981 | Busby | 340/750 |
| 4,345,245 | 8/1982 | Vella et al. | 340/744 |
| 4,496,976 | 1/1985 | Swanson et al. | 340/798 |
| 4,586,156 | 4/1986 | Kurata et al. | 340/731 |

*Primary Examiner*—Gerald L. Brigance

*Assistant Examiner*—Jeffery A. Brier

*Attorney, Agent, or Firm*—Robert T. Mayer; Bernard Franzblau

[57] ABSTRACT

A data display arrangement in which selected characters arranged in rows of characters which are displayed on the screen of a CRT can be enlarged selectively at the expense of obscuring other characters, or of preventing other characters from being displayed enlarged size. The character size for a displayed character is determined by a size attribute code which accompanies the character code for the character. If an attribute code for a character is changed, the change in the size of the character as displayed can reveal previously obscured characters, which in turn may be displayed different size if an accompanying attribute code of that effect can now be implemented. These changes can result in ripple effects through the whole display. The invention provides a register and buffer arrangement in which character data and size attribute data for each character position of each character row is examined and altered in accordance with an "obscured character algorithm" which allows ripple effects to occur and ensures that data for display at obscured positions is not lost.

9 Claims, 8 Drawing Figures

VARIABLE SIZE CHARACTER DISPLAY WITHOUT LOSS OF OBSCURED CHARACTER POSITIONS

BACKGROUND OF THE INVENTION

1. Field of the Invention

This invention relates to data display arrangements of a type for displaying on the screen of a raster scan display device data represented by digital codes, the displayed data being composed of discrete characters arranged in character rows each comprising a number of character positions.

2. Description of the Prior Art

Data display arrangements of the above type have application in video terminals of a variety of different data display systems for displaying data on the screen of a CRT (cathode ray tube) or other raster scan display device. One such data display system, for instance, is used in conjunction with telephone data services which offer a telephone subscriber having a suitable video display terminal the ability to gain access over the public telephone network to data sources from which data can be selected and transmitted in digitally coded form to the subscriber's premises for display. Examples of this usage are the British and German videotex services Prestel and Bildschirmtext.

A data display arrangement of the above type can include, in addition to the CRT or other display device, acquisition means for acquiring transmission information which represents characters selected for display and also represents size and other attributes for the characters, memory means for storing derived digital codes, and a character memory in which is stored character data identifying the available character shapes which the arrangement can display. This character information is selectively addressed in accordance with the stored digital codes and the information read out is used to produce character generating signals for the data display. Where, as would usually be the case, the display is on the screen of a CRT, this selective addressing is effected synchronously with the scanning action of the CRT.

To facilitate this selective addressing, it is convenient to store the character information as patterns of discrete dots which define the character shapes as corresponding patterns of data bits in respective character memory cell matrices. With this form of storage, the dot pattern of a character shape as displayed on the screen of the CRT can have a one-to-one correspondence with the stored bit pattern for the character. The display may be produced with or without interlaced field scanning.

In order to further facilitate the aforesaid selective addressing, it is also convenient to display characters of a standard size arranged in character rows which can contain up to a fixed maximum possible number of character positions. This standardization determines the size for a rectangular character display area at each position, composed of a plurality of dot rows, which is required for displaying one character. In general, the dot rows are displayed once in successive scanning lines in each field.

With a view to enhancing the display facilities of the data display arrangement, the selective display of characters of normal height, double height, double width and double size has been proposed. For this proposal, a double height character will occupy two corresponding character display areas in adjacent character rows, a double width character will occupy two adjacent character display areas in the same character row, and a double size character will occupy two adjacent character display areas in the same character row and the two corresponding character display areas in an adjacent character row. However, in order to avoid having to store double height, double width and double size bit patterns, it is usual instead to modify the addressing of the existing stored bit patterns for normal height characters.

This modified addressing can be determined by so-called "attribute" logic which causes each bit row of a normal character bit pattern to be read-out an appropriate number of times to expand the character as displayed to the requisite size.

The different size characters, as displayed, may be randomly interleaved. However, because each of the different forms of expanded characters encroach into adjacent display areas which might otherwise be occupied by other characters, certain rules govern the display of expanded characters. These Rules can be:

1. A double height character extends downwards and obscures the character below it. The origin of the character is the upper character position.

2. A double width character extends to the right and obscures the character to its right. The origin of the character is the left hand character position.

3. A double size character extends both downwards and to the right and obscures the three characters, below it, to its right, and to its right and below. The origin of the character is the top left character position.

The effects of these rules are illustrated symbolically in FIG. 1 which will now be considered. In FIG. 1, DBH=double height attribute, DBW=double width attribute, DBS=double size attribute, and NSE=normal size attribute. Sketch (a) illustrates Rule 1. This sketch shows four stored characters A,B,C,D in memory MEM. Character A has the attribute DBH stored with it, so it is displayed double height in display DIS. The character C is obscured in the display, but remains in memory and so will be seen if the attribute DBH is removed. Sketch (b) shows that with the attribute DBW acting on the character A, the character B is obscured, and sketch (c) shows that with the attribute DBS acting on the character A, all the characters B, C and D are obscured.

The obscuring by enlarged characters will also have the effect that if the origin of an enlarged character is obscured, then that character does not display at all. Sketch (d) illustrates this effect; i.e. the double height character B obscures the origin for the character E which would otherwise be displayed double size. Also, sketch (e) illustrates that parts of enlarged characters may not be displayed because of obscuring; i.e. character C is displayed only normal size because of the double height character B. In general, the display priority is in scan-order in that the attribute of the character which is scanned first is considered first.

It has been found that the above rules and their individual effects can give rise to "ripple" effects through the entire display. For instance, if the character A in sketch (d) is given the attribute DBW, as shown in sketch (f), then it can be seen that the entire display is altered. The character B is obscured by the double width character A, so that the origin of the double size character E is no longer obscured by the double height character B and is therefore displayed. It will be appreciated that in an entire display composed of many characters, the overall ripple effect can be considerable. (It should be mentioned that stored characters with no size attribute are displayed normal size. The attribute NSE is provided to revert characters to normal size display following the display in the same character row of an enlarged character).

SUMMARY OF THE INVENTION

It is an object of the present invention to provide a means of effecting the display of characters in the circumstances set forth above without a loss of data corresponding to obscured character positions.

According to the invention, there is provided a data display arrangement of the type referred to in which said digital codes represent both character data which identifies character shape and attribute data which identifies character size, and there are included means for selectively displaying in accordance with the received data a character either normal size in one character position or enlarged size in at least two corresponding character positions in adjacent character rows. The arrangement is characterized in that said means includes a twin row buffer comprising two buffers each of which can hold the character and attribute data for all the positions of a row of characters and which function alternately as either a "fill" row buffer for receiving character and attribute data for a character row, or as a "display" row buffer for providing such previously received data for the display of the preceding character row, together with means operable in respect of each character position of the current "fill" row buffer to examine the corresponding character position in the current "display" row buffer and to insert into the "fill" row buffer position the attribute data for the "display" row buffer position, if the latter position is for the top half of an enlarged size character.

In carrying out the invention, in the case where an enlarged size character may also occupy two adjacent character positions in the same character row, said means can include further means for examining the next position after said corresponding position in the current "display" row buffer, to restrict the size attribute data for said "fill" row buffer position to normal character width, if said next position is for the top half of an enlarged character.

BRIEF DESCRIPTION OF THE DRAWINGS

In order that the invention may be more fully understood reference will now be made by way of example to the accompanying drawings, in which.

DESCRIPTION OF THE PREFERRED EMBODIMENT

Figure 1A:
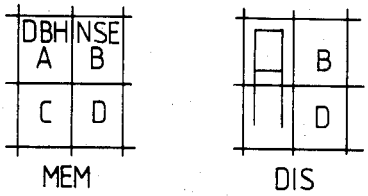
FIGS. 1*a*–1*f* illustrate symbolically the storage and display of different size characters.
Figure 1B:
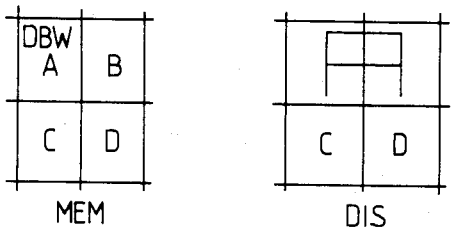
Figure 1C:
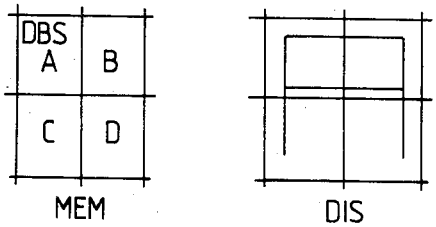
Figure 1D:
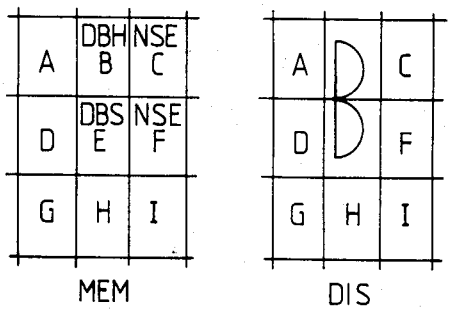
Figure 1E:
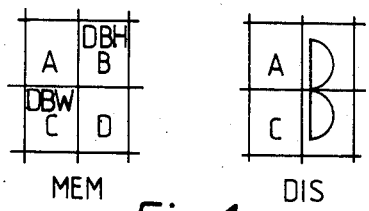
Figure 1F:
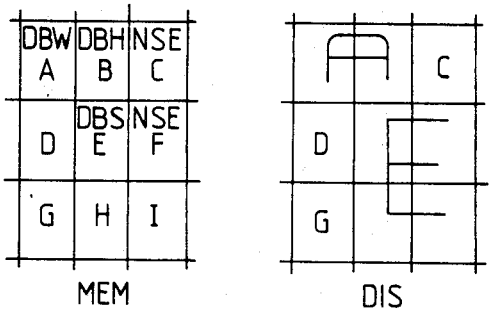
Figure 2:
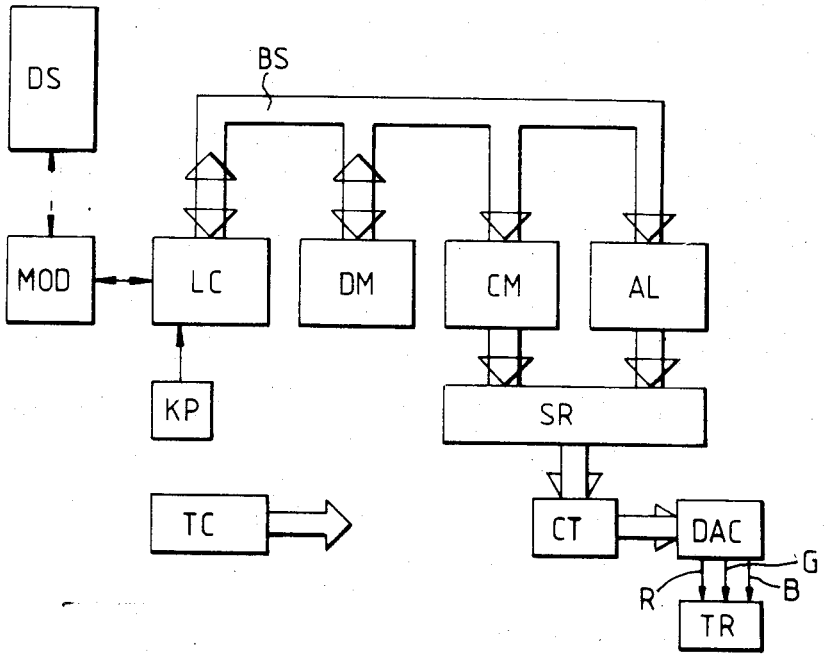
FIG. 2 shows diagrammatically a video display terminal having a data display arrangement in which the invention can be embodied.

Referring to the drawings, the video display terminal shown in FIG. 2 comprises a modem MOD by means of which the terminal has access over a telephone line TL (e.g. via a switched public telephone network) to a data source DS. A logic and processor circuit LC provides the signals necessary to establish the telephone connection to the data source DS. The circuit LC also includes data acquisition means for acquiring transmission information from the telephone line TL. A command keypad KP provides user control instructions to the circuit LC. A common address/data bus BS interconnects the circuit LC with a display memory DM and a character memory CM. Under the control of the circuit LC, digital codes derived from the received transmission information and representing characters for display are loaded onto the data bus BS and assigned to an appropriate location in the display memory DM. There is also provided as part of the data display arrangement, attribute logic AL which contains control data relating to different display attributes, such as "flashing", "underlining", "color choice", "double height", "double width", "double size", etc. Data which identifies the various attributes to be applied to the displayed characters is included in the received transmission information and stored in the display memory DM along with the display data which identifies the actual character shapes. Thereafter, addressing and read out means in the circuit LC accesses the character and attribute data stored in the display memory DM and supplies modified data to address selectively the character memory CM and the attribute logic AL to produce character and attribute information. Shift registers SR receive this information and use it to drive a color look-up table CT to produce therefrom digital color codes which are applied to a digital-to-analog converter DAC. The output signals from the converter DAC are the R,G,B, character generating signals required for driving a television receiver TR to display on the screen thereof the characters represented by the display data. A timing circuit TC provides the timing control for the data display arrangement.

There is included in the addressing and read out means of the circuit LC a register and buffer arrangement which operates on character and attribute data read out from the display memory DM to supply the modified data used to address the character memory CM and the attribute logic AL. As will be considered next with reference to FIG. 3, this operation is inter alia such as to provide for the display of different size characters simultaneously without loss of data for obscured character positions.

Figure 3:
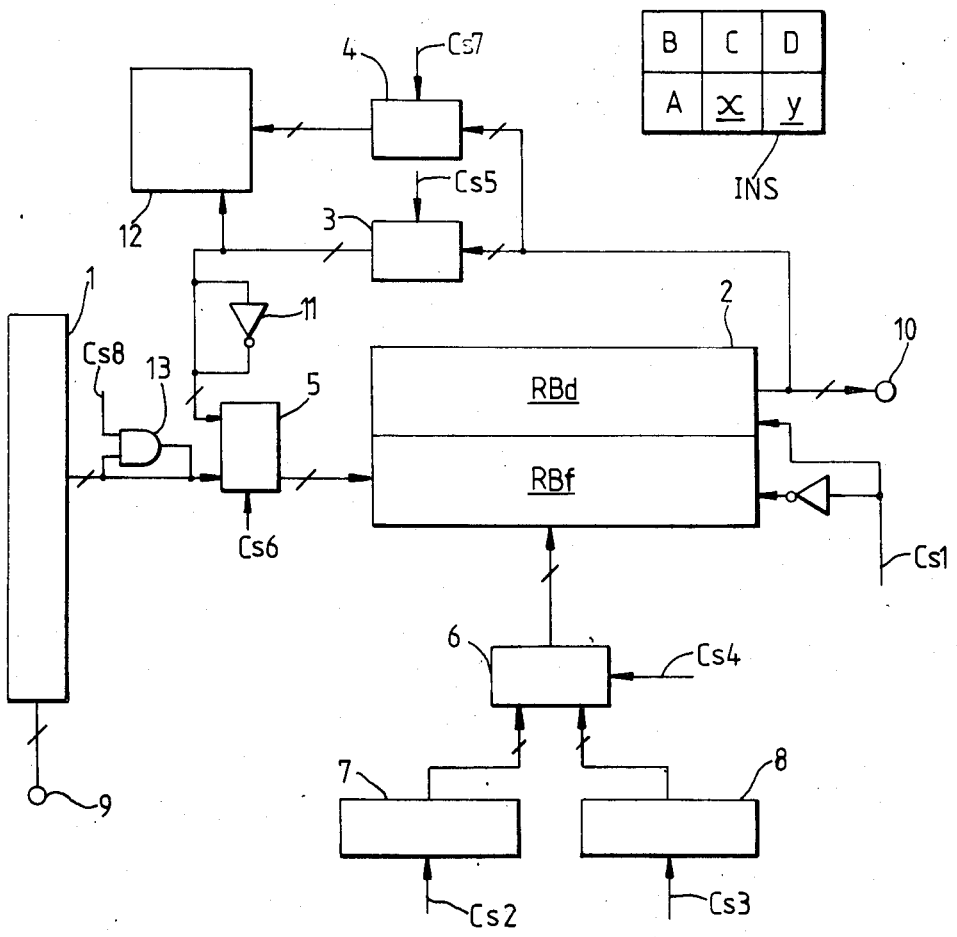
FIG. 3 shows diagrammatically a buffer arrangement according to the invention.

The register and buffer arrangement shown in FIG. 3 comprises a pertaining fill register 1, a twin row buffer 2, two temporary registers 3 and 4, two multiplexers 5 and 6, a "fill" addresser 7 and a "display" addresser 8. Various control signals Cs for the arrangement are assumed to be provided by control logic 12.

Character and attribute data from the display memory (DM-FIG. 2) is applied to the pertaining fill register 1 at an input 9, this data being dealt with one character at a time. The twin row buffer 2 has two buffers each of which can hold the character and attribute data for a complete display row of characters, and they function alternately as either a "fill" row buffer or a "display" row buffer. In the drawing, RBd is assumed to be the current "display" row buffer and RBf the current "fill" row buffer. A control signal Csl switches the two row buffers for their alternate functions for successively displayed rows of characters. The display data is fed from the "display" row buffer RBd at an output 10.

Each time the character and attribute data for a character position in a character row is to be written into the "fill" row buffer RBf, the register 1 is initially fully defined with the appropriate character and attribute data from the external display memory (DM-FIG. 2). If there were no enlarged characters, the contents of the register 1 could simply be transferred to the "fill" row buffer RBf and the process started again for the next character position. Generally, however, there will be enlarged characters in the display. Therefore, before the data in the register 1 for each character position is transferred to the "fill" row buffer RBf, the data for the corresponding character position of the previous character row is inspected to find out if that corresponding position contains the top half of a double height character. The insert INS in FIG. 3 illustrates a current "fill" character position x, relative to which is the corresponding position C in the previous character row. Adjacent positions B, D and A are also shown.

The data for the position C is available in the "display" row buffer RBd and is read out and held in the temporary register 3. The addresser 7 addresses the "fill" row buffer RBf for the fill operation under the control of a control signal Cs2, and it is also used to effect the read out from the "display" row buffer RBd into the temporary register 3. The display addresser 8 cannot be used for this purpose because it is driven by a control signal Cs3 at a different rate (i.e. the character display rate) and therefore is unlikely to be addressing the position C at the same time that the addresser 7 is addressing the position x. The addressers 7 and 8 address the row buffer RBd and RBf via the multiplexer 6 which is switched for this addressing by a control signal Cs4. Similarly, the data for the position D in the "display" row buffer RBd is read out and held in the temporary register 4. This, of course, requires incrementing the addresser 7 to the next character position and then decrementing it to return it to the current "fill" position x. This is achieved by the control logic 12 with control signal Cs2.

If position C has data for a double height, (or double size) top half of a character, this is detected by the control logic 12 from the data stored in the temporary register 3 and this data, instead of the data in the register 1, is transferred via the multiplexer 5 into the "fill" position x of the "fill" row buffer RBd, but with the code bit indicating a "top half" character being changed to indicate a "bottom half" character. An inverter 11 in one bit line of the connection between register 3 and the multiplexer 5 signifies this bit change. A control signal Cs5 controls the entry of data into the register 3, and a control signal Cs6 controls the switching of the multiplexer 5. In this way, all the attribute data from position C becomes effective equally for both the top and bottom halves of a double height character identified at position C. Any attributes set at or pertaining to the "fill" position x are held in the register 1 for consideration at the next character position to be filled in the "fill" row buffer RBf. This assumes a method of allocating attributes whereby once an attribute is set at a given character position by the appropriate attribute data, it remains active (pertaining) until either a contradictory attribute is set at a subsequent character position in the character row concerned or until the end of the row. Thus, once attribute data for a given character position has been loaded into the register 1, it remains there for transfer into the "fill" row buffer RBf in subsequent character positions up to the end of the character row, unless contradictory attribute data is received.

The content of the other temporary register 4 is set under the control of a further control signal Cs7. In this instance, the register content need only be 2 bits, one for determining double height (size) and the other for determining the top or bottom half character, because the attribute data for position D can never be effective in the "fill" position x and so will never be transferred there. If the content of register 4, as determined by the control logic 12, indicates that position D has data for a double height (or double size) top half of a character (double width=don't care), then the "fill" position x may not initiate double width display. The data from the register 1 is transferred to the "fill" position x, but any double width attribute bit is set to be made ineffective. This setting is signifed by a control signal Cs8 applied to a gate 13 in one bit line of the connection between the register 1 and the multiplexer 5. Thus, the character for "fill" position x becomes normal size if it was to be double width, and double height if it was to be double size. On the basis of the known method of allocating attributes mentioned above, it will be apparent that if the character for position x is to be double width, the data in the register 1 is effectively transferred to both the position x and the next position y (see insert INS) of the "fill" row buffer RBf.

As regards the attribute integrity, if, say, position C is for a double height, top half character to be displayed red, and position x is for a normal size character to be displayed green, then the 'red' attribute is in the register 3 and is transferred to position x, while the 'green' attribute remains in the register 1 because the normal size character for position x is an obscured character. The 'green' attribute will apply to the character in the next position y, if the position D is for a normal size character. Therefore, in general, attributes set at obscured positions do not take immediate effect, rather they are implemented at subsequent positions in the same character row where those locations are not obscured.

I claim:

1. A data display apparatus for displaying on a screen of a raster scan display device data represented by digital codes, the displayed data being comprised of discrete characters arranged in character rows each comprising a number of character positions, in which said digital codes represent both character data which identifies character shape and attribute data which identifies character size, said apparatus comprising, means for selectively displaying in accordance with the received data a character either normal size in one character position or enlarged size in at least two corresponding character positions in adjacent character rows, characterized in that said means includes a twin row buffer comprising two buffers each of which can hold the character and attribute data for all of the positions of a row of characters and of which one functions as a "fill" row buffer for receiving character and attribute data for a character row and the other as a "display" row buffer for providing such previously received data for the display of the preceding character row, and vice versa alternately, means operable in respect of each character position of the current "fill" row buffer for examining the corresponding character position in the current "display" row buffer and to insert into the "fill" row buffer position the attribute data for the "display" row buffer position, if the latter position is for the top half of an enlarged size character.

2. A data display apparatus as claimed in claim 1, in which an enlarged size character may also occupy two adjacent character positions in the same character row, characterized in that further means are provided for examining the next position after said corresponding character position in the current "display" row buffer, to restrict the size attribute data for said "fill" row buffer position to a character size not requiring said next position, if said next position is for the top half of an enlarged size character.

3. A data display apparatus as claimed in claim 1 or claim 2, comprising character/attribute register means connected to receive the character data and attribute data for each character position of a character row in turn, addressing means for accessing each character position of the current "fill" row buffer in turn and the corresponding position of the current "display" row buffer, and a temporary register connected to receive the data at the accessed "display" row buffer position, the data in the temporary register being fed to the accessed "fill" row buffer position instead of the data in the character/attribute register in the event that the data in the temporary register pertains to the top half of an enlarged character.

4. A data display apparatus as claimed in claim 3, further comprising means for modifying the data transferred from the temporary register to the accessed "fill" row buffer position so as to identify said data as pertaining to the lower half of the enlarged size character concerned.

5. A data display apparatus as claimed in claim 3, characterized in that said further means comprises a second temporary register connected to receive that part of the attribute data in said next position of the "display" row buffer which identifies character size, together with means for incrementing and decrementing said addressing means to access said next position temporarily for feeding said attribute data part to the second temporary register, and means for modifying the data transferred to the accessed "fill" row buffer position so as to identify this data as pertaining only to a character size not requiring said next position, in the event that said attribute data part signifies the top half of an enlarged size character.

6. A data display apparatus as claimed in claim 4, characterized in that said further means comprises a second temporary register connected to receive that part of the attribute data in said next position of the "display" row buffer which identifies character size, together with means for incrementing and decrementing said addressing means to access said next position temporarily for feeding said attribute data part to the second temporary register, and means for modifying the data transferred to the accessed "fill" row buffer position so as to identify said data as pertaining only to a character size not requiring said next position, in the event that said attribute data part signifies the top half of an enlarged size character.

7. A data display apparatus for displaying digital data on a screen of a raster scan display device in the form of rows of characters each comprising a number of character positions, said digital data composed of character data and attribute data, said apparatus comprising, means responsive to the digital data for selectively displaying characters in normal size in one character position or enlarged size in at least two corresponding character positions in adjacent character rows, first and second buffer registers each of which can store character and attribute data for all positions of a row of characters, said first and second buffers being operative alternately with one buffer functioning as a fill row buffer for receiving character and attribute data for a character row and the other buffer functioning as a display row buffer providing previously received data for display of a preceding character row, and vice versa, and means operable for each character position of the current fill row buffer for examining the corresponding character position in the current display row buffer to selectively supply attribute data to the fill row buffer as determined by the data present in the display row buffer.

8. A data display apparatus as claimed in claim 7 further comprising character/attribute register means connected to receive in turn the character data and attribute data for each character position of a character row, addressing means for accessing in turn each character position of the current fill row buffer and the corresponding position of the current display row buffer, and a temporary register connected to receive the data at the accessed display row buffer position and with the data in the temporary register being fed to the accessed fill row buffer position instead of the data in the character/attribute register in the event that the data in the temporary register pertains to an enlarged character.

9. A data display apparatus as claimed in claim 8 further comprising control logic means for supplying timing control signals to said first and second buffers, to said addressing means and to said temporary register.

* * * * *